US012467188B2

(12) United States Patent
Liu et al.

(10) Patent No.: US 12,467,188 B2
(45) Date of Patent: Nov. 11, 2025

(54) LAUNDRY DEVICE AND VALVE ASSEMBLY

(71) Applicants: QINGDAO HAIER WASHING MACHINE CO., LTD., Shandong (CN); Haier Smart Home Co., Ltd., Shandong (CN)

(72) Inventors: Kai Liu, Qingdao (CN); Sheng Xu, Qingdao (CN); Wenwei Li, Qingdao (CN); Zhiqiang Zhao, Qingdao (CN)

(73) Assignees: QINGDAO HAIER WASHING MACHINE CO., LTD, Qingdao (CN); HAIER SMART HOME CO., LTD, Qingdao (CN)

( * ) Notice: Subject to any disclaimer, the term of this patent is extended or adjusted under 35 U.S.C. 154(b) by 184 days.

(21) Appl. No.: 18/552,228

(22) PCT Filed: Mar. 24, 2022

(86) PCT No.: PCT/CN2022/082622
§ 371 (c)(1),
(2) Date: Sep. 25, 2023

(87) PCT Pub. No.: WO2022/199641
PCT Pub. Date: Sep. 29, 2022

(65) Prior Publication Data

US 2024/0175196 A1 May 30, 2024

(30) Foreign Application Priority Data

Mar. 25, 2021 (CN) ..... 202110321845.0

(51) Int. Cl.
*D06F 37/26* (2006.01)
*D06F 25/00* (2006.01)
(Continued)

(52) U.S. Cl.
CPC ..... *D06F 37/267* (2013.01); *D06F 25/00* (2013.01); *D06F 37/30* (2013.01); *D06F 35/008* (2013.01); *D06F 37/266* (2013.01)

(58) Field of Classification Search
CPC ..... D06F 25/00; D06F 35/008; D06F 37/267; D06F 37/30; D06F 37/266
See application file for complete search history.

(56) References Cited

U.S. PATENT DOCUMENTS 4,112,590 A * 9/1978 Muller ..... D06F 58/24 34/77
6,434,857 B1 * 8/2002 Anderson ..... F26B 21/083 68/19

(Continued)

FOREIGN PATENT DOCUMENTS

CN 102251368 A 11/2011
CN 102286872 A 12/2011

(Continued)

OTHER PUBLICATIONS

International Search Report and Written Opinion issued on Jun. 30, 2022, in corresponding International Application No. PCT/CN2022/082622, 14 pages.

*Primary Examiner* — Joseph L. Perrin
(74) *Attorney, Agent, or Firm* — Maier and Maier, PLLC

(57) ABSTRACT

A laundry device, including a barrel assembly, a valve assembly, and a fan, where the valve assembly includes a blocking mechanism and a valve housing which has an air intake cavity and an air outlet cavity, the air intake cavity and the air outlet cavity are arranged independent of each other, the air intake cavity communicates with air intake pipelines that connect the outside with the barrel assembly, the air outlet cavity communicates with air outlet pipelines that connect the outside with the barrel assembly, the fan is provided on the air intake pipelines and/or the air outlet (Continued)

pipelines, and the blocking mechanism is arranged to be able to simultaneously block the air intake pipelines and the air outlet pipelines. The structure is simple, the overall structure arrangement of products is facilitated, and the design complexity is reduced.

10 Claims, 4 Drawing Sheets

(51) Int. Cl.
*D06F 37/30* (2020.01)
*D06F 35/00* (2006.01)

(56) References Cited

U.S. PATENT DOCUMENTS 8,984,692 B2 * 3/2015 Balinski ..... D06F 33/43 8/149.1
11,085,137 B2 * 8/2021 Salvi ..... D06F 37/304
2006/0123854 A1 * 6/2006 Hong ..... D06F 58/22 68/24
2008/0078209 A1 * 4/2008 Kim ..... D06F 58/203 68/4
2013/0104607 A1 * 5/2013 Broitzman ..... D06F 29/00 68/13 R
2014/0290313 A1 * 10/2014 Kulkarni ..... D06F 25/00 68/19.2
2023/0059400 A1 * 2/2023 Damtew ..... F24F 11/0001

FOREIGN PATENT DOCUMENTS

CN 106498683 A 3/2017
CN 215887608 U 2/2022
CN 215887609 U 2/2022
DE 102018105920 A1 9/2019
JP 2004261317 A 9/2004
TW I708000 B 10/2020

* cited by examiner

LAUNDRY DEVICE AND VALVE ASSEMBLY

FIELD

The present disclosure belongs to the technical field of clothing washing, and specifically provides a washing apparatus and a valve assembly.

BACKGROUND

A washing apparatus is a clothing treatment apparatus that can perform washing, rinsing, spinning and/or drying operations on clothing. Some washing apparatuses are further provided with functions such as air washing, disinfection, sterilization and fragrance enhancement. There are many types of washing apparatuses, such as the most common drum washing machine, a pulsator washing machine, and a washing-drying integrated machine.

Taking the drum washing machine as an example, existing drum washing machines include an outer cylinder and an inner cylinder. During washing, a certain amount of water is first injected into the outer cylinder, and then the inner cylinder drives the clothing to turn over, achieving washing of the clothing. The drum washing machine is designed by imitating the principle of striking the clothing with a bar hammer. After the clothing is washed, the outer cylinder and a window gasket connected to the outer cylinder are both moist, that is, there is residual water on an inner wall thereof. After long term use, growth of bacteria is very likely to occur. In case of only opening door glass to dry the outer cylinder and the window gasket naturally, the effect would be very limited; moreover, the window gasket includes a wrinkle part, which is very unfavorable for the release of water vapor. During secondary use of the drum washing machine by users, the bacteria and dirt on the inner wall of the outer cylinder and in the window gasket can easily cause secondary pollution to the clothing, seriously affecting the washing effect and resulting in poor user experience. In the washing-drying integrated machine, a drying system is at least added on the basis of the traditional drum washing machine, so that the drum washing machine has a drying function, and some models can also achieve air washing. However, although the drying system can dry the outer cylinder and the window gasket by heating the residual water after the clothing is washed, all the drying systems of the washing-drying integrated machines adopt an internal circulation mode, which makes the water vapor still circulate between a drying air duct and the outer cylinder. Moreover, dehumidification of the washing-drying integrated machine mainly relies on a dehumidification device of the drying system. Therefore, if the residual water in the outer cylinder and the window gasket is to be further removed after a drying program is completed, the drying system has to remain in operation, which will seriously increase energy consumption of the washing machine and is very unfavorable for energy saving.

A drum washing machine is disclosed in patent document with patent number 201922216894.9, which includes an air inflow pipeline and an air outflow pipeline with a fan. The air inflow pipeline and the air outflow pipeline are both communicated with the outer cylinder. Flowing air can enter the outer cylinder and air-dry an inner surface of the outer cylinder and an outer surface of the inner cylinder. The flowing air is then discharged out of the body of the drum washing machine through the air outflow pipeline. That is, the interior of the outer cylinder is air-dried by external air, thus avoiding dirt generation and bacteria growth. However, this type of drum washing machine cannot guarantee that external dirt does not enter the drum washing machine, and still has certain safety hazards.

A vent structure and a washing machine are disclosed in patent document with patent number 201810106076.0. The vent structure includes a vent and a rotating body. The rotating body is rotatably arranged at the vent, and the rotating body is radially provided with a first connecting hole that runs therethrough. When the rotating body rotates, the first connecting hole can be communicated with the vent, or the vent is blocked by the rotating body, thereby selectively communicating the first connecting hole with the vent, and achieving the purpose of opening or closing the vent through the rotation of the rotating body. The vent structure can be arranged on a front panel of a housing of the washing machine, or also arranged in a rear vent at the same time. However, if the vent structure is only arranged on the front panel, external dirt can easily enter the drum washing machine from the rear vent, and if the vent structure is also arranged in the rear vent at the same time, it is necessary to close the two vent structures respectively to completely block the drum washing machine from the outside, which is very unfavorable for the layout of product structure and will seriously increase the complexity of product design.

Accordingly, there is a need for a new washing apparatus and valve assembly in the art to solve the above problem.

SUMMARY

In order to solve the above problem in the prior art, that is, to solve the problem of complicated structure of existing washing apparatuses when external air is used to achieve air drying of the outer cylinder, which is not advantageous for simplified design of the product structure, the present disclosure provides a washing apparatus, which includes a cylinder assembly, a valve assembly and a fan; the valve assembly includes a blocking mechanism, and a valve casing with an air inflow cavity and an air outflow cavity; the air inflow cavity and the air outflow cavity are arranged independently from each other; an air inflow pipeline that communicates the outside with the cylinder assembly is communicated with the air inflow cavity, and an air outflow pipeline that communicates the outside with the cylinder assembly is communicated with the air outflow cavity; the fan is arranged on the air inflow pipeline and/or the air outflow pipeline, and the blocking mechanism is arranged to be capable of blocking the air inflow pipeline and the air outflow pipeline simultaneously.

In a preferred technical solution of the washing apparatus described above, the blocking mechanism includes a driving motor, a first blocking member and a second blocking member; an output shaft of the driving motor is connected to the first blocking member and the second blocking member simultaneously; the first blocking member is arranged in the air inflow cavity, the second blocking member is arranged in the air outflow cavity, and the driving motor can drive the first blocking member and the second blocking member to move simultaneously to block the air inflow cavity and the air outflow cavity.

In a preferred technical solution of the washing apparatus described above, the driving motor is connected to a transmission shaft, the first blocking member is a first blocking plate, and the second blocking member is a second blocking plate; both the first blocking plate and the second blocking plate are arranged on the transmission shaft, and the driving motor can drive the transmission shaft to rotate so that the first blocking plate and the second blocking plate rotate simultaneously.

In a preferred technical solution of the washing apparatus described above, the transmission shaft passes through the air outflow cavity and the air inflow cavity in sequence from the outside from one side of the valve casing, and the transmission shaft is rotatably arranged on a partition that separates the air inflow cavity from the air outflow cavity.

In a preferred technical solution of the washing apparatus described above, the air inflow pipeline includes a first air inflow pipe and a second air inflow pipe; the first air inflow pipe communicates an air inlet of the air inflow cavity with the outside, and the second air inflow pipe communicates an air outlet of the air inflow cavity with the cylinder assembly.

In a preferred technical solution of the washing apparatus described above, the fan is arranged on the first air inflow pipe.

In a preferred technical solution of the washing apparatus described above, the air outflow pipeline includes a first air outflow pipe and a second air outflow pipe; the first air outflow pipe communicates the cylinder assembly with an air inlet of the air outflow cavity, and the second air outflow pipe communicates an air outlet of the air outflow cavity with the outside.

In a preferred technical solution of the washing apparatus described above, an opening communicated with the outside is arranged on a front panel of a cabinet of the washing apparatus, and the second air outflow pipe is communicated with the opening.

In a preferred technical solution of the washing apparatus described above, the cylinder assembly includes an outer cylinder and a window gasket that are connected; the air inflow pipeline is communicated with the window gasket, the air outflow pipeline is communicated with the outer cylinder, and a communication port for the communication between the air inflow pipeline and the window gasket is arranged on the window gasket in a tangential direction.

In another aspect, the present disclosure also provides a valve assembly, which includes a blocking mechanism, and a valve casing with an air inflow cavity and an air outflow cavity; the air inflow cavity and the air outflow cavity are arranged independently from each other, and the blocking mechanism is arranged to be capable of blocking the air inflow cavity and the air outflow cavity simultaneously.

In the preferred technical solutions of the present disclosure, after the washing apparatus completes a washing program, external air can be introduced into the air inflow pipeline by starting the fan; then, the external air enters the cylinder assembly to air dry the interior of the cylinder assembly, and is finally discharged from the air outflow pipeline to avoid bacteria growth due to residual water inside the cylinder assembly. After the washing apparatus completes the air-drying program, the blocking mechanism can block the air inflow pipeline and the air outflow pipeline simultaneously, so that the cylinder assembly is completely blocked from the outside, which can not only prevent external dust and the like from entering the cylinder assembly, but also can prevent foam from overflowing out of the washing apparatus when the washing apparatus is washing. That is, the above functions of blocking the entry of external dust and preventing the foam from overflowing can be achieved through one blocking mechanism. In addition, the blocking mechanism can block and cut off the air inflow pipeline and the air outflow pipeline simultaneously, so that the structure is simple, which is advantageous for the overall structural layout of the product and reduces the complexity of product design.

Further, the driving motor can drive the first blocking member to block the air inflow cavity, and simultaneously drive the second blocking member to block the air outflow cavity, thereby achieving simultaneous blocking of the air inflow pipeline and the air outflow pipeline. That is, the driving motor is used as a driving source to achieve simultaneous blocking of the air inflow pipeline and the air outflow pipeline. The overall structure is simple, which is advantageous for the overall structural layout of the product and reduces the complexity of product design.

Further, the driving motor can drive the transmission shaft to rotate, so that the first blocking plate and the second blocking plate can rotate, thereby achieving simultaneous blocking of the air inflow cavity and the air outflow cavity. Through such an arrangement, not only the air inflow pipeline and the air outflow pipeline can be blocked simultaneously, but also the space that the valve assembly has to occupy can be minimized by rotational driving, which is more advantageous for the layout design of the overall spatial structure of the washing apparatus. Moreover, the structure is simple and the manufacture is easy.

Further, the driving motor is arranged outside the valve casing, so that the transmission shaft protrudes into the valve casing to drive the first blocking plate and the second blocking plate to rotate. Through such an arrangement, a structural basis is provided for the structural installation of the driving motor. Moreover, arranging the driving motor outside the valve casing will not affect the flow of air, and there is no safety hazard of the driving motor being covered by moist air, thus further improving the safety of the washing apparatus.

Further, the air inflow pipeline is communicated with the window gasket, and the air outflow pipeline is communicated with the outer cylinder, so that external air can enter from the window gasket. The window gasket is air-dried first, then the outer cylinder is air-dried, and finally the moist air is discharged through the air outflow pipeline, allowing both the outer cylinder and the window gasket to be air-dried simultaneously, and avoiding secondary pollution caused when the user performs secondary cleaning of the clothing, which would otherwise affect the user experience in use.

Further, the communication port for the communication between the air inflow pipeline and the window gasket is arranged on the window gasket in a tangential direction, which can ensure that external air enters the window gasket in the tangential direction, so as to form a circular airflow inside the window gasket, which is advantageous for air-drying the window gasket without dead corners and improving the effect of air-drying.

BRIEF DESCRIPTION OF DRAWINGS

Preferred solutions of the present disclosure will be described below with reference to the accompanying drawings and in connection with a drum washing machine. In the drawings.

DETAILED DESCRIPTION

Figure 1:
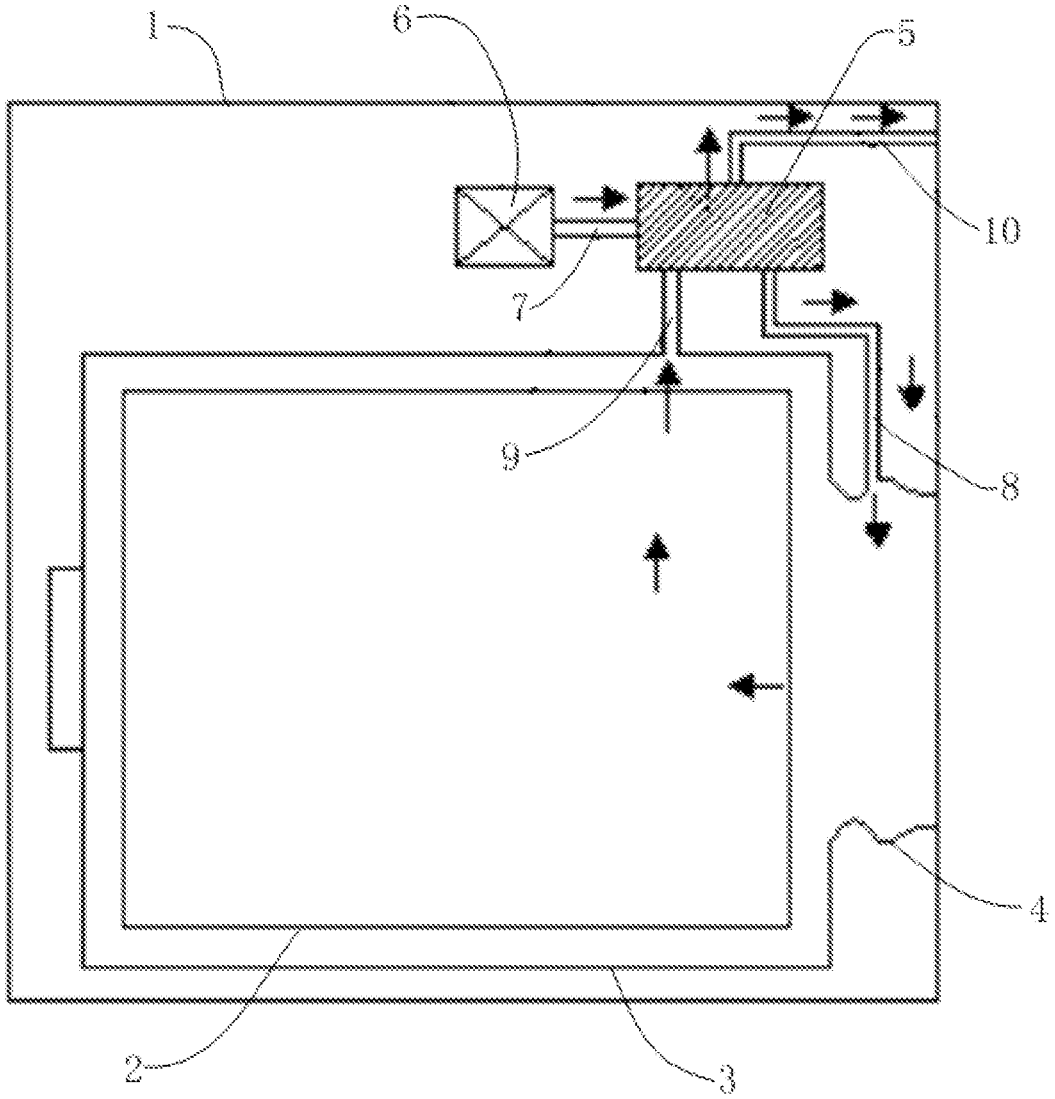
FIG. 1 is a first schematic structural view of the drum washing machine of the present disclosure.

First, it should be understood by those skilled in the art that these embodiments are only used to explain the technical principle of the present disclosure, and are not intended to limit the scope of protection of the present disclosure. For example, although the present disclosure is described in connection with a drum washing machine, the technical principle of the present disclosure is obviously also applicable to a washing-drying integrated machine, or a complex clothing treatment apparatus. Such adjustments or changes to the application object do not constitute limitations to the present disclosure, and should all be defined within the scope of protection of the present disclosure.

Second, although the valve assembly of the present disclosure is described in connection with the specific structure inside the drum washing machine, the valve assembly can also be applied to other fields, such as air conditioners, numerically controlled machine tools, food processing devices, etc. Such adjustments or changes to the application object do not constitute limitations to the present disclosure, and should all be defined within the scope of protection of the present disclosure.

It should be noted that in the description of the present disclosure, terms indicating directional or positional relationships, such as "middle", "upper", "lower", "left", "right", "horizontally", "inner", "outer" and the like, are based on the directional or positional relationships shown in the accompanying drawings. They are only used for ease of description, and do not indicate or imply that the device or element must have a specific orientation, or be constructed or operated in a specific orientation; therefore, they should not be considered as limitations to the present disclosure. In addition, terms "first", "second" and "third" are merely used for descriptive purpose, and should not be understood as indicating or implying relative importance.

In addition, it should also be noted that in the description of the present disclosure, unless otherwise clearly specified and defined, terms "arrange", "install", "connect" and "communicate" should be understood in a broad sense; for example, the connection may be a fixed connection, or may also be a detachable connection, or an integral connection; it may be a direct connection, or an indirect connection implemented through an intermediate medium, or it may be internal communication between two elements. For those skilled in the art, the specific meaning of the above terms in the present disclosure can be interpreted according to specific situations.

In view of the problem of complicated structure of existing drum washing machines when external air is used to achieve air drying of the outer cylinder pointed out in the "BACKGROUND", which is not advantageous for simplified design of the product structure, the present disclosure provides a washing apparatus, aiming to achieve simultaneous blocking of air inflow pipeline and air outflow pipeline, thus further achieving a dual blocking effect, i.e., blocking the entry of external dust after the air-drying program is completed, and preventing foam from overflowing during a washing process of clothing; the structure is simple, which is advantageous for the overall structural layout of the product and reduces the complexity of product design.

Figure 2:
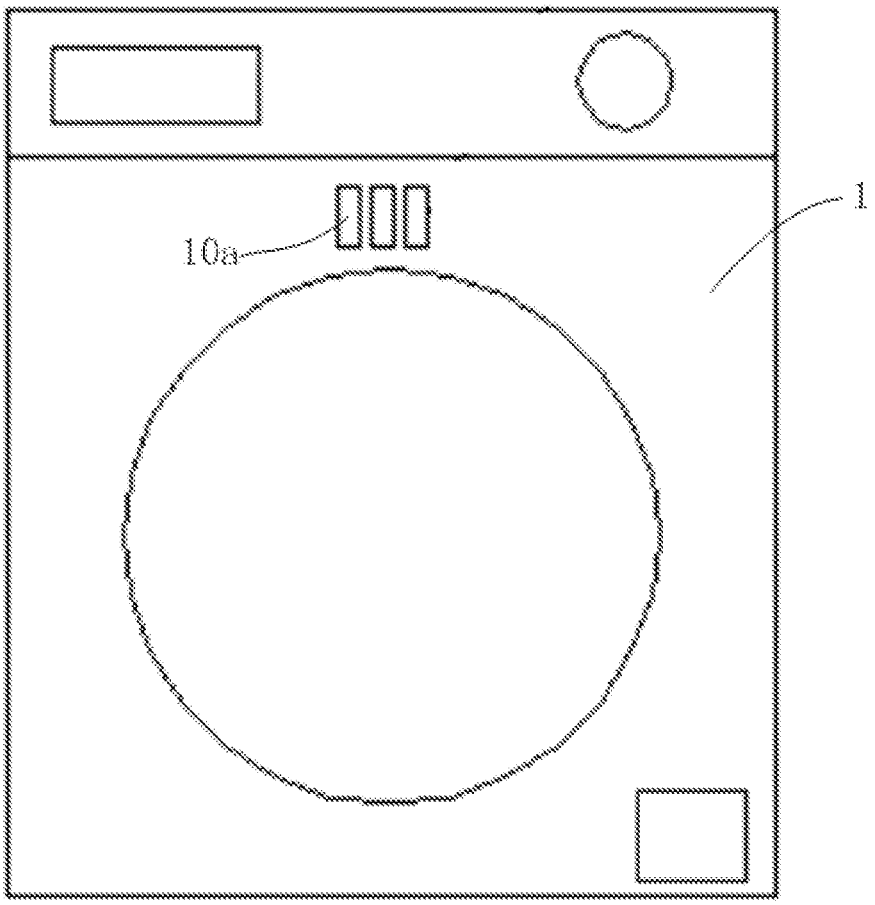
FIG. 2 is a second schematic structural view of the drum washing machine of the present disclosure.

Specifically, as shown in FIGS. 1 and 2, the drum washing machine of the present disclosure includes a cabinet 1 and a cylinder assembly arranged inside the cabinet 1. The cylinder assembly includes an inner cylinder 2, an outer cylinder 3, and a window gasket 4. The inner cylinder 2 is rotatably arranged in the outer cylinder 3, and the window gasket 4 connects an opening of the outer cylinder 3 to a door opening of the cabinet 1. In a top-loaded drum washing machine, the outer cylinder 3 and the inner cylinder 2 are coaxial and both horizontally arranged, and the window gasket 4 connects an upper opening of the outer cylinder 3 to the door opening at the top of the cabinet 1. In a front-loaded drum washing machine, the outer cylinder 3 and the inner cylinder 2 are coaxial and both horizontally arranged, and the window gasket 4 connects a front opening of the outer cylinder 3 to the door opening at the front of the cabinet 1. FIG. 1 shows a schematic structural view of the front-loaded drum washing machine. It can be understood by those skilled in the art that the inner cylinder 2 can be directly driven to rotate by a direct driving motor, and can also be driven to rotate by a belt, which is driven by a motor. The outer cylinder 3 is used to hold washing water, the inner cylinder 2 is used to turn over the clothing, and the window gasket 4 ensures the sealing between the outer cylinder 3 and the cabinet 1.

It should be noted that the conventional washing program of the drum washing machine includes washing, rinsing, spinning and draining processes. In some drum washing machines, the spinning process may be omitted from the washing program. Such adjustments or changes to the conventional washing program of the drum washing machine do not constitute limitations to the present disclosure, and should all be defined within the scope of protection of the present disclosure. A large amount of foam will be generated during the washing process due to the presence of detergent/washing powder, and after the draining process is completed, there will be residual water on both an inner surface of the outer cylinder 3 and an inner surface of the window gasket 4.

Figure 3:
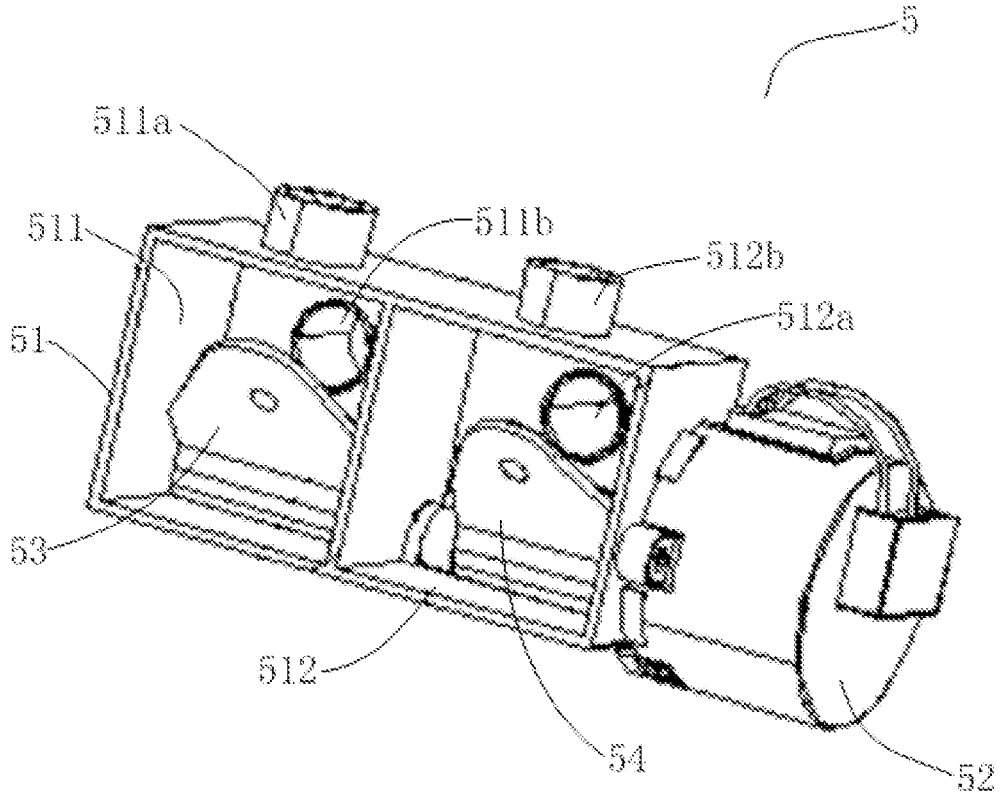
FIG. 3 is a schematic structural view of an embodiment of the valve assembly of the present disclosure.

With continued reference to FIGS. 1 and 3, the drum washing machine of the present disclosure further includes a valve assembly 5 and a fan 6. The valve assembly 5 includes a blocking mechanism, and a valve casing 51 with an air inflow cavity 511 and an air outflow cavity 512. The air inflow cavity 511 and the air outflow cavity 512 are arranged independently from each other. An air inflow pipeline that communicates the outside with the cylinder assembly is communicated with the air inflow cavity 511, and an air outflow pipeline that communicates the outside with the cylinder assembly is communicated with the air outflow cavity 512. The fan 6 is arranged on the air inflow pipeline and/or the air outflow pipeline, and the blocking mechanism is arranged to be capable of blocking the air inflow pipeline and the air outflow pipeline simultaneously. The air inflow cavity 511 has an air inlet 511*a* and an air outlet 511*b*, and the air outflow cavity 512 also has an air inlet 512*a* and an air outlet 512*b*. As to the air inflow pipeline that communicates the outside with the cylinder assembly being communicated with the air inflow cavity 511, it is possible that the outside is directly communicated with the air inlet 511*a* of the air inflow cavity 511, and then the air outlet 511*b* of the air inflow cavity 511 is communicated with the cylinder assembly through the air inflow pipeline, or it is possible that the air inflow pipeline has two sections, one of which communicates the outside with the air inlet 511*a* of the air inflow cavity 511, and the other of which communicates the air outlet 511*b* of the air inflow cavity 511 with the cylinder assembly. Similarly, as to the air outflow pipeline that communicates the outside with the cylinder assembly being communicated with the air outflow cavity 512, it is possible that the air outlet 512*b* of the air outflow cavity 512 is directly communicated with outside, and then the cylinder assembly is communicated with the air inlet 512*a* of the air outflow cavity 512 through the air outflow pipeline, or it is possible that the air outflow pipeline has two sections, one of which communicates the cylinder assembly with the air inlet 512*a* of the air outflow cavity 512, and the other of which communicates the air outlet 512*b* of the air outflow cavity 512 with the outside. The fan 6 can be arranged on the air inflow pipeline, or on the air outflow pipeline, or both the air inflow pipeline and the air outflow pipeline have a fan 6 arranged thereon, as long as air can be introduced from the air inflow pipeline under the action of the fan 6 and moist air can be discharged through the air outflow pipeline after air drying of the cylinder assembly is completed. In a possible situation, with continued reference to FIGS. 1 and 3, the air inflow pipeline includes a first air inflow pipe 7 and a second air inflow pipe 8; the first air inflow pipe 7 communicates the air inlet 511*a* of the air inflow cavity 511 with the outside, and the second air inflow pipe 8 communicates the air outlet 511*b* of the air inflow cavity 511 with the cylinder assembly. The air outflow pipeline includes a first air outflow pipe 9 and a second air outflow pipe 10; the first air outflow pipe 9 communicates the cylinder assembly with the air inlet 512*a* of the air outflow cavity 512, and the second air outflow pipe 10 communicates the air outlet 512*b* of the air outflow cavity 512 with the outside. After the washing program of the drum washing machine is completed, a controller of the drum washing machine can send a signal to the fan 6 to start the fan 6. The fan 6 rotates to allow air to enter the cylinder assembly through the first air inflow pipe 7, the air inflow cavity 511 and the second air inflow pipe 8 in sequence, achieving air drying of the cylinder assembly. Then, moist air passes through the first air outflow pipe 9, the air outflow cavity 512 and the second air outflow pipe 10 in sequence before being discharged, allowing the moist air to be discharged to the outside.

In the above, the fan 6 is preferably arranged on the first air inflow pipe 7, so that the air can be sucked in from the first air inflow pipe 7 immediately after the fan 6 is started, and the foam generated in the washing process of the drum washing machine will also be blocked in the air inflow cavity 511, so that the operation of the fan 6 will not be affected. In other examples, the fan 6 can also be arranged on the second air outflow pipe 10, that is, on a downstream side of the air outflow cavity 512, and the foam generated in the washing process of the drum washing machine will also be blocked in the air outflow cavity 512, so that the operation of the fan 6 will not be affected. Of course, on the premise of ensuring the sealing tightness or controlling the amount of foam generated, the fan 6 can also be arranged on the second air inflow pipe 8 and/or the first air outflow pipe 9. Air blowing from one side of the fan 6 to the other side can be achieved through blade design of the fan 6 (as shown in FIG. 1, air is introduced from the left side of the fan 6 to the right side), and a detained description will be omitted herein. The above specific arrangement positions of the fan 6 do not constitute limitations to the present disclosure, and should all be defined within the scope of protection of the present disclosure. In addition, in the above, with continued reference to FIG. 2, an opening 10*a* communicated with the outside is arranged on a front panel of the cabinet of the drum washing machine. Then, the second air outflow pipe 10 is communicated with the opening 10*a*, that is, moist air can be discharged to the outside through the opening 10*a* on the front panel. In other examples, the outlet of the second air outflow pipe 10 can also directly pass out of the opening 10*a*, that is, the opening 10*a* is only used as an installation port of the second air outflow pipe 10, and the moist air is directly discharged to the outside through the outlet of the second air outflow pipe 10. In a case where the moist air is led out to the outside through the opening 10*a* on the front panel of the cabinet, a decorative cover can be arranged on the opening 10*a*, and the decorative cover can be configured into a grid-like structure or a hidden structure. In other examples, the opening 10*a* is not limited to being arranged on the front panel of the cabinet, and it can also be arranged on a left-side panel or a right-side panel, or can even be arranged on a control panel, or on a console where a display screen is installed. Such adjustments or changes to the specific arrangement position of the opening 10*a* should all be defined within the scope of protection of the present disclosure. In addition, in a possible situation, the fan 6 can be arranged at the inlet of the first air inflow pipe 7, and the inlet of the first air inflow pipe 7 is located inside a housing of the drum washing machine. In other examples, the inlet of the first air inflow pipe 7 can be located outside the housing, such as on an outer side of a rear panel of the housing.

Preferably, the blocking mechanism includes a driving motor 52, a first blocking member and a second blocking member; an output shaft of the driving motor 52 is connected to the first blocking member and the second blocking member simultaneously; the first blocking member is arranged in the air inflow cavity 511, the second blocking member is arranged in the air outflow cavity 512, and the driving motor 52 can drive the first blocking member and the second blocking member to move simultaneously to block the air inflow cavity 511 and the air outflow cavity 512. The driving motor 52 can be a rotating motor that ultimately outputs a rotational force, or a linear motor that ultimately outputs a linear driving force. For example, in a preferred situation, the driving motor 52 is connected to a transmission shaft, the first blocking member is a first blocking plate 53, and the second blocking member is a second blocking plate 54. The first blocking plate 53 and the second blocking plate 54 are both arranged on the transmission shaft, and the driving motor 52 can drive the transmission shaft to rotate so that the first blocking plate 53 and the second blocking plate 54 rotate simultaneously. That is, the driving motor 52 is a rotating motor, and the driving motor 52 can drive the transmission shaft to rotate. The transmission shaft drives both the first blocking plate 53 and the second blocking plate 54 to rotate simultaneously. The air inlet 511*a* and the air outlet 511*b* of the air inflow cavity 511 can be located on opposite sides of the air inflow cavity 511 respectively, or can be located on adjacent sides of the air inflow cavity 511 respectively (FIG. 3 shows the arrangement on adjacent sides). Similarly, the air inlet 512*a* and the air outlet 512*b* of the air outflow cavity 512 can be located on opposite sides of the air outflow cavity 512 respectively, or can be located on adjacent sides of the air outflow cavity 512 respectively (FIG. 3 shows the arrangement on adjacent sides). According to the respective arrangement positions of the air inlet and air outlet of the air inflow cavity 511 and the air inlet and air outlet of the air outflow cavity 512, respective ways of blocking of the first blocking plate 53 and the second blocking plate 54 can be flexibly set. In a preferred situation, the air outlet 511*b* of the air inflow cavity 511 and the air inlet 512*a* of the air outflow cavity 512 are arranged on the same side of the valve casing 51, that is, the air outlet 511*b* of the air inflow cavity 511 and the air inlet 512*a* of the air outflow cavity 512 are located on the same side. The driving motor 52 drives the transmission shaft to rotate so that the first blocking plate 53 can cover the air outlet 511*b* of the air inflow cavity 511, thereby achieving the blocking of the air inflow pipeline; at the same time, the second blocking plate 54 can cover the air inlet 512*a* of the air outflow cavity 512, thereby achieving the blocking of the air outflow pipeline. Moreover, since it is the air outlet 511*b* of the air inflow cavity 511 and the air inlet 512*a* of the air outflow cavity 512 that are covered respectively, even if foam is generated in the washing process of the drum washing machine, the foam will not enter the air inflow cavity 511 and the air outflow cavity 512. Further preferably, a side of the first blocking plate 53 that faces the air outlet 511*b* of the air inflow cavity 511 and a side of the second blocking plate 54 that faces the air inlet 512*a* of the air outflow cavity 512 are both provided with a sealing gasket, so that sealing can be achieved when the first blocking plate 53 covers the air outlet 511*b* of the air inflow cavity 511, and sealing can also be achieved when the second blocking plate 54 covers the air inlet 512*a* of the air outflow cavity 512. In other examples, the sealing gasket on the first blocking plate 53 can be replaced with a sealing ring that can correspond to the shape of the air outlet 511*b* of the air inflow cavity 511, and the sealing gasket on the second blocking plate 54 can be replaced with a sealing ring that can correspond to the shape of the air inlet 512*a* of the air outflow cavity 512.

Preferably, the transmission shaft passes through the air outflow cavity 512 and the air inflow cavity 511 in sequence from the outside from one side of the valve casing 51, and is rotatably arranged on a partition that separates the air inflow cavity 511 from the air outflow cavity 512. In a possible situation, a first through hole is formed on a side of the valve casing 51 that forms the air outflow cavity 512, a second through hole is formed on the partition, and the transmission shaft passes through the first through hole and the second through hole in sequence. A part of the transmission shaft that is located between the first through hole and the second through hole (i.e., the part located inside the air outflow cavity 512) is connected to the second blocking plate 54, and a part of the transmission shaft that passes out of the second through hole (i.e., the part located inside the air inflow cavity 511) is connected to the first blocking plate 53. In addition, the transmission shaft can be connected to an edge of the first blocking plate 53 and an edge of the second blocking plate 54, so that the rotation of the transmission shaft can achieve synchronous swaying of the first blocking plate 53 and the second blocking plate 54. In addition, a third through hole can also be provided on the valve casing 51 on an opposite side to the first through hole, and a protruding end of the transmission shaft can be located inside the third through hole. Through such an arrangement, the transmission shaft can be supported by the first through hole, the second through hole and the third through hole together, thus improving the stability of support. The driving motor 52 is located on the outer side of the valve casing 51 and can be connected to the cabinet 1 of the drum washing machine through an installation bracket, or the driving motor 52 is directly welded to the cabinet 1 of the drum washing machine. In other examples, the transmission shaft can also pass through the air inflow cavity 511 and the air outflow cavity 512 in sequence from the outside from one side of the valve casing 51.

Alternatively, the driving motor 52 is a linear motor, the first blocking member is a first blocking plate, and the second blocking member is a second blocking plate. A first slot communicated with the air inflow cavity 511 and a second slot communicated with the air outflow cavity 512 are formed on the same side of the valve casing 51 respectively. The first blocking plate is matched with the first slot by insertion, and the second blocking plate is matched with the second slot by insertion. The linear motor can drive the first blocking plate and the second blocking plate to move linearly in synchronization. When it is necessary to block the air inflow cavity 511 and the air outflow cavity 512, the linear motor drives the first blocking plate to be inserted into the air inflow cavity 511 from the first slot, so that the first blocking plate blocks the air inlet 511*a* and the air outlet 511*b* of the air inflow cavity 511 from each other. At the same time, the linear motor drives the second blocking plate to be inserted into the air outflow cavity 512 from the second slot, so that the second blocking plate blocks the air inlet 512*a* and the air outlet 512*b* of the air outflow cavity 512 from each other.

Figure 4:
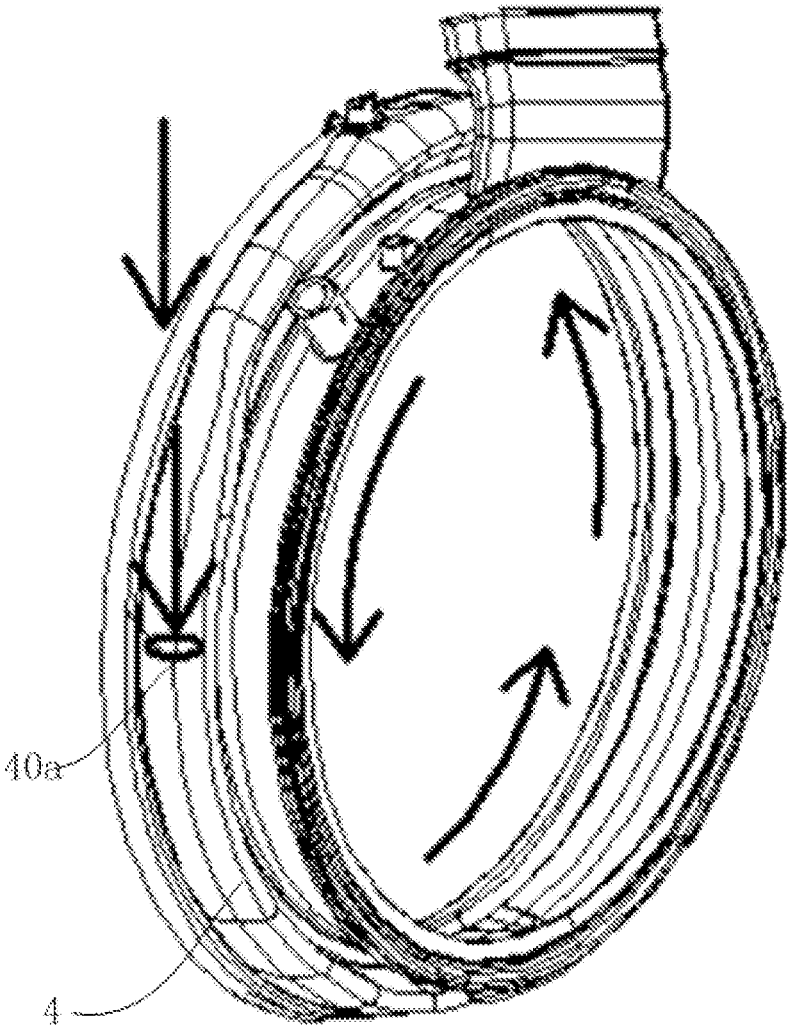
FIG. 4 is a schematic structural view of the window gasket of the drum washing machine of the present disclosure.

Preferably, the air inflow pipeline is communicated with the window gasket 4, and the air outflow pipeline is communicated with the outer cylinder 3 (the air outflow pipeline is preferably communicated with a rearward part of a side wall of the outer cylinder 3 to increase an air-drying area of the outer cylinder 3); that is, the window gasket 4 and the outer cylinder 3 can be air dried simultaneously. Moreover, even if the user forgets to take out the clothing after the drum washing machine completes washing, the window gasket 4 and the outer cylinder 3 can be air-dried by turning on the fan 6 to prevent the clothing from producing odor. Further preferably, as shown in FIG. 4, a communication port 40*a* for the communication between the air inflow pipeline and the window gasket 4 is arranged on the window gasket 4 in the tangential direction. Through such an arrangement, the wind entering the window gasket 4 from the air inflow pipeline comes from the tangential direction, so that a circular airflow can be formed in the window gasket 4, thereby achieving air-drying of the window gasket 4. Moreover, the communication port 40*a* is preferably arranged at a wrinkle part of the window gasket 4, so as to air-dry the wrinkle part of the window gasket 4. The air inflow pipeline can also form multiple branches; for example, multiple branches are formed in a terminal section of the second air inflow pipe 8 of the drum washing machine shown in FIG. 1. The multiple branches are respectively communicated with multiple communication ports 40*a* located on the window gasket 4, and the branches correspond to the communication ports 40*a* in a one-to-one correspondence. The multiple communication ports 40*a* are arranged at equal or unequal intervals in a circumferential direction of the window gasket 4, and each communication port 40*a* is arranged in the same tangential direction on the window gasket 4. Being arranged in the same tangential direction mentioned above means that when viewed right in front of the window gasket 4 (that is, a circular structure of the window gasket 4 can just be seen), all the communication ports 40*a* are oriented in a clockwise tangential direction of the circumference of the window gasket 4 or in a counterclockwise tangential direction of the circumference of the window gasket 4, so that a clockwise or counterclockwise circular airflow is formed inside the window gasket 4, thus air-drying various parts of the window gasket 4 without dead corners, and further improving the air-drying effect.

Hitherto, the technical solutions of the present disclosure have been described in connection with the preferred embodiments shown in the accompanying drawings, but it is easily understood by those skilled in the art that the scope of protection of the present disclosure is obviously not limited to these specific embodiments. Without departing from the principles of the present disclosure, those skilled in the art can make equivalent changes or replacements to relevant technical features, and all the technical solutions after these changes or replacements will fall within the scope of protection of the present disclosure.

What is claimed is:

1. A washing apparatus comprising:

a cabinet;

a cylinder assembly arranged inside the cabinet and including an inner cylinder, an outer cylinder, and a window gasket, wherein the inner cylinder is rotatably arranged in the outer cylinder and the window gasket is connected with the outer cylinder;

a valve assembly;

an air inflow pipeline communicated with the window gasket;

an air outflow pipeline communicated with the outer cylinder; and a fan arranged on the air inflow pipeline and/or the air outflow pipeline;

wherein the valve assembly comprises a blocking mechanism, and a valve casing having an air inflow cavity and an air outflow cavity formed within the valve casing;

wherein the air inflow cavity and the air outflow cavity are arranged independently from each other;

wherein the blocking mechanism comprises a driving motor, a first blocking member and a second blocking member;

wherein an output shaft of the driving motor is connected to the first blocking member and the second blocking member simultaneously;

wherein the first blocking member is arranged in the air inflow cavity, the second blocking member is arranged in the air outflow cavity, and the driving motor is configured to drive the first blocking member and the second blocking member to move simultaneously to block the air inflow cavity and the air outflow cavity;

wherein the driving motor is connected to a transmission shaft, the first blocking member is a first blocking plate, and the second blocking member is a second blocking plate;

wherein both the first blocking plate and the second blocking plate are arranged on the transmission shaft;

wherein the air inflow pipeline is arranged to communicate an outside of the washing apparatus with the cylinder assembly and to be communicated with the air inflow cavity, and the air outflow pipeline is arranged to communicate the outside of the washing apparatus with the cylinder assembly and to be communicated with the air outflow cavity; and wherein the driving motor is configured to drive the transmission shaft to rotate so that the first blocking plate and the second blocking plate rotate simultaneously to block the air inflow pipeline and the air outflow pipeline simultaneously.

2. The washing apparatus according to claim 1, wherein the transmission shaft passes through the air outflow cavity and the air inflow cavity in sequence from the outside from one side of the valve casing, and the transmission shaft is rotatably arranged on a partition that separates the air inflow cavity from the air outflow cavity.

3. The washing apparatus according to claim 1, wherein the air inflow pipeline comprises a first air inflow pipe and a second air inflow pipe; the first air inflow pipe communicates an air inlet of the air inflow cavity with the outside, and the second air inflow pipe communicates an air outlet of the air inflow cavity with the cylinder assembly.

4. The washing apparatus according to claim 3, wherein the fan is arranged on the first air inflow pipe.

5. The washing apparatus according to claim 1, wherein the air outflow pipeline comprises a first air outflow pipe and a second air outflow pipe; the first air outflow pipe communicates the cylinder assembly with an air inlet of the air outflow cavity, and the second air outflow pipe communicates an air outlet of the air outflow cavity with the outside.

6. The washing apparatus according to claim 5, wherein an opening communicated with the outside of the washing apparatus is arranged on a front panel of the cabinet of the washing apparatus, and the second air outflow pipe is communicated with the opening.

7. The washing apparatus according to claim 1, wherein a communication port for the communication between the air inflow pipeline and the window gasket is arranged on the window gasket in a tangential direction.

8. A valve assembly, comprising:

a blocking mechanism; and a valve casing having an air inflow cavity and an air outflow cavity formed within the valve casing;

wherein the air inflow cavity and the air outflow cavity are arranged independently from each other;

wherein the blocking mechanism comprises a driving motor, a first blocking member and a second blocking member;

wherein an output shaft of the driving motor is connected to the first blocking member and the second blocking member simultaneously;

wherein the first blocking member is arranged in the air inflow cavity, the second blocking member is arranged in the air outflow cavity;

wherein the driving motor is connected to a transmission shaft, the first blocking member is a first blocking plate, and the second blocking member is a second blocking plate; and wherein both the first blocking plate and the second blocking plate are arranged on the transmission shaft, and the driving motor is configured to drive the transmission shaft to rotate so that the first blocking plate and the second blocking plate rotate simultaneously to block the air inflow cavity and the air outflow cavity simultaneously.

9. The valve assembly according to claim 8, wherein the transmission shaft passes through the air outflow cavity and the air inflow cavity in sequence from one side of the valve casing, and the transmission shaft is rotatably arranged on a partition that separates the air inflow cavity from the air outflow cavity.

10. The valve assembly according to claim 8, wherein each of the air inflow cavity and the air outflow cavity comprises an air inlet and an air outlet.

* * * * *